United States Patent [19]

Vickers et al.

[11] 3,956,874

[45] May 18, 1976

[54] PACKAGING MACHINE USING TWO-BLANK CARTON SYSTEM

[75] Inventors: James Lee Vickers, Harbert, Mich.; Edmund A. Waycie, River Forest, Ill.

[73] Assignee: Stone Container Corporation, Chicago, Ill.

[22] Filed: July 3, 1975

[21] Appl. No.: 592,927

Related U.S. Application Data

[63] Continuation-in-part of Ser. No. 480,160, June 17, 1974, Pat. No. 3,896,601.

[52] U.S. Cl. ..... 53/207; 53/387

[51] Int. Cl.[2] ..... B65B 11/18

[58] Field of Search ..... 53/207, 228, 230, 387

[56] References Cited

UNITED STATES PATENTS

| | | | |
|---|---|---|---|
| 3,555,776 | 1/1971 | Nigrelli et al. | 53/207 X |
| 3,911,644 | 10/1975 | Myers et al. | 53/207 |

*Primary Examiner*—Travis S. McGehee
*Assistant Examiner*—John Sipos
*Attorney, Agent, or Firm*—Silverman & Cass, Ltd.

[57] ABSTRACT

A packaging machine operative to sequentially fold separate cooperating carton blanks about lading and discharge a sealed package containing the lading in an automatic operation. The packaging machine is particularly adapted to cooperate with a lading loading ram which could be provided by a conventional case packer having a discharge horn through which the ram moves a quantity of lading. The carbon blank system includes a body blank having a center panel and alternate side panels with flanges hingedly connected along the longitudinal edges of the panels and along the ends of the side panels and a cover blank having a center panel and alternate side panels. The machine includes means for positioning the body blank in a generally vertical plane opposite the loading ram, means for folding the flanges and the panels about the lading in cooperation with said loading ram to form a generally U-shaped formation, means for holding the said formation in place, conveyor means including top and bottom transport sections synchronized in their movements for moving the formation to an end flange folding station and thereafter to a discharge station, means for positioning a cover blank opposite the outlelt of the discharge station, means for moving the formation against the cover blank, means for folding the cover blank about the formation, and cam-actuated bracket means for retaining the outer facing surfaces of the folded flanges of the body blank in folded-over position until the same are engaged by the inner facing margin of the cover blank to form a sealed package or carton. Formation and sealing of the package is achieved along a horizontal path of movement.

13 Claims, 6 Drawing Figures

67'
71
79
4
48
55
51'
5
99
91
5
64
83
85
81'
85'
81'
83'
83
81
85'
85
81'
83'
142
61
83
65
85
81
57
67
50
73
75
4
77
51
53
59

99
93
101
91
103
107
105
106
81'
97
95
98
24
64
142b
81
81'
142a
81
81'
42
142
43
81
50

PACKAGING MACHINE USING TWO-BLANK CARTON SYSTEM

CROSS-REFERENCES TO RELATED APPLICATION

This application is a continuation-in-part of application Ser. No. 480,160 filed June 17, 1974, now U.S. Pat. No. 3,896,601 (herein called the Related Patent). having the same title as this application.

BACKGROUND OF THE INVENTION

The Related Patent is incorporated herein by specific reference for the purpose of the background of the invention, the field of the invention, the description of the prior art, and the detailed description of the elements of the present disclosure which are common with that of the Related Patent, as will be referred to specifically herein.

The invention herein differs from the invention of the Related Patent in that a new conveyor mechanism is provided having top and bottom transport sections which are synchronized in their movement, each section having restrainer brackets for engaging a respective folded blank and lading formation and thereby enable more positive engagement and accurate movement of the formation along the conveyor mechanism for faster and improved operation of the packaging machine.

The invention herein also includes novel end flange engagement and retaining members for holding the end flanges of the body blank in folded-over position as the body blank leaves the discharge station of the packaging machine for engagement with the cover blank. The retaining members are withdrawn from engagement with the end flanges prior to engagement of the body blank with the cover blank. The retaining members are moved away from the end flanges by cam-operated means to permit the body blank to proceed through the machine.

SUMMARY OF THE INVENTION

According to the invention there is provided a machine for forming a sealed package containing lading from a generally rectangular body blank of paperboard material and a generally rectangular cover blank of a flexible paper or paper-like material. The body blank includes a center panel, alternate, hingedly connected side panels and flanges hingedly connected along the longitudinal edges of the center and side panels and along the ends of the side panels. The cover blank includes a center panel and alternate hingedly connected side panels. Said machine includes first means for positioning the body blank in a generally vertical plane adjacent the outlet of a lading moving station from which a quantity of lading is moving horizontally in one direction, conveying means positioned for horizontal movement in a direction laterally of said one direction, said conveying means including a receiving station adjacent said lading moving station and a discharge station spaced downstream from said receiving station, second means at said receiving station for folding the body blank into a generally U-shaped formation partially surrounding a quantity of lading with the center panel forming an end wall and the side panels forming two side walls of the formation as the quantity of lading is moved from the lading moving station, engages the body blank and moves onto said conveying means, third means at said receiving station for folding the flanges along each longitudinal edge of the body blank to positions generally perpendicular to the associated side walls and end wall during movement of the lading against the body blank and onto said conveying means, fourth means for folding the end flanges to a position generally perpendicular to the associated side walls, said conveying means including top and bottom transport sections for engaging a folded body blank therebetween, said transport sections being operatively synchronized to move in unison and jointly index a folded body blank and lading along said conveying means to said discharge station, fifth means for positioning the cover blank in a generally vertical plane adjacent said discharge station, sixth means at said discharge station for moving the folded body blank and lading laterally off of said conveying means and against the cover blank, seventh means at said discharge station for folding the cover blank into a U-shaped formation partially surrounding the lading with the margin of the cover blank positioned overlying the flanges of the folded body blank as the folded body blank formation is moved off of said conveying means and eighth means adjacent said discharge station for retaining the flanges of the body blank in folded-over position until the same are engaged by the adjacent facing margin of the cover blank, said eighth means including cam-actuated bracket members for moving into engagement with the end flanges and thereafter moving out of engagement with the end flanges prior to engagement of the body blank in abutting relation with the cover blank.

DESCRIPTION OF THE PREFERRED EMBODIMENT

Generally, the purposes and functions of the packaging machine of the present invention are explained in detail in the Related Patent incorporated herein by specific reference. As explained above, there are differences between the machine of the present invention and that of the Related Patent which improve upon the latter (1) to enable more precise and rapid movement of the folded blank and lading formation along the conveyor mechanism, and (2) to maintain the end flanges of the body blank of the formation in folded-over position as the body blank leaves the discharge station of the packaging machine.

Figure 1:
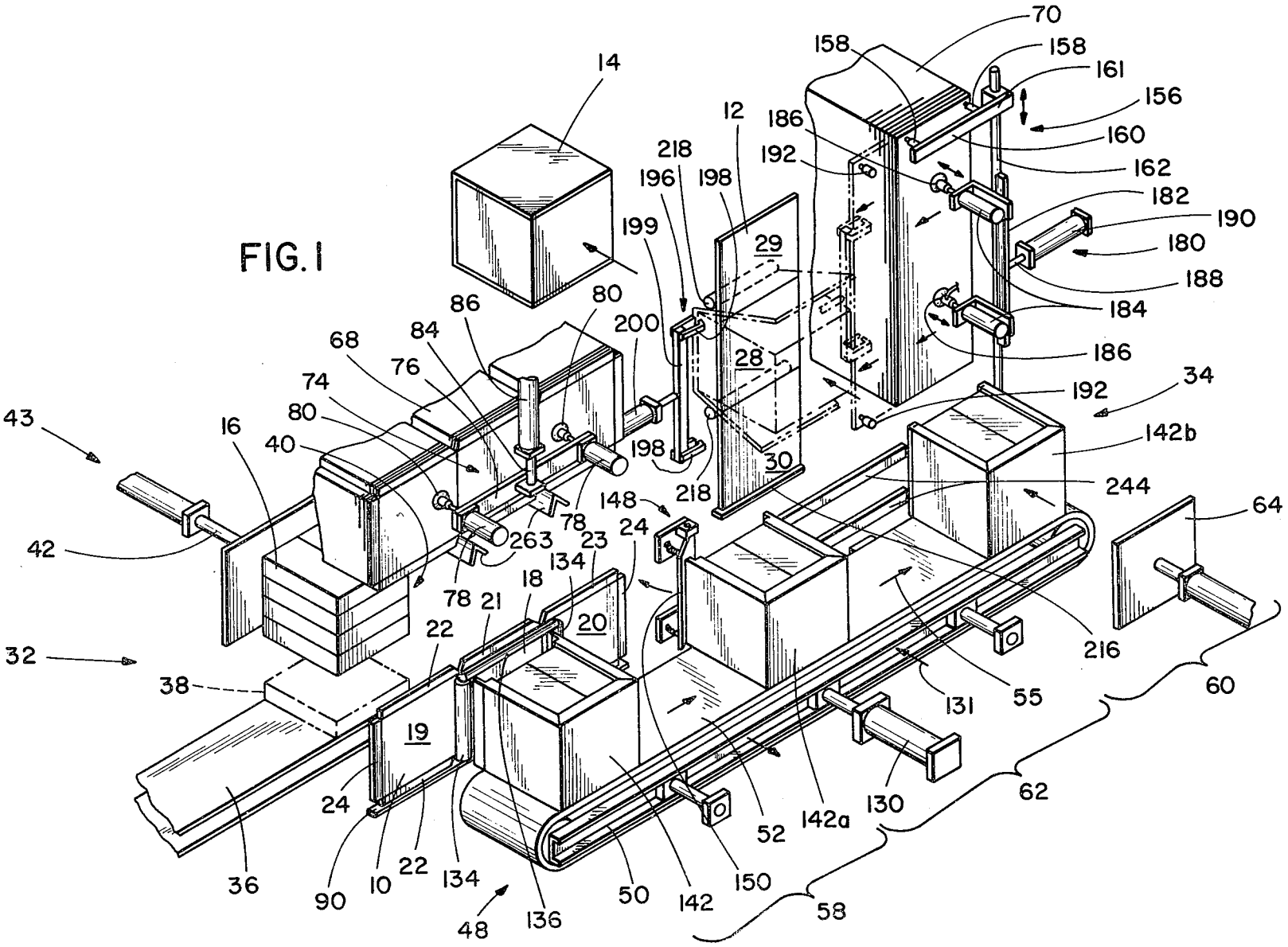
FIG. 1 is a flow diagram identical to FIG. 1 of the Related Patent illustrating the manner in which two blanks are folded about a quantity of lading to form a sealed package.
Figure 2:
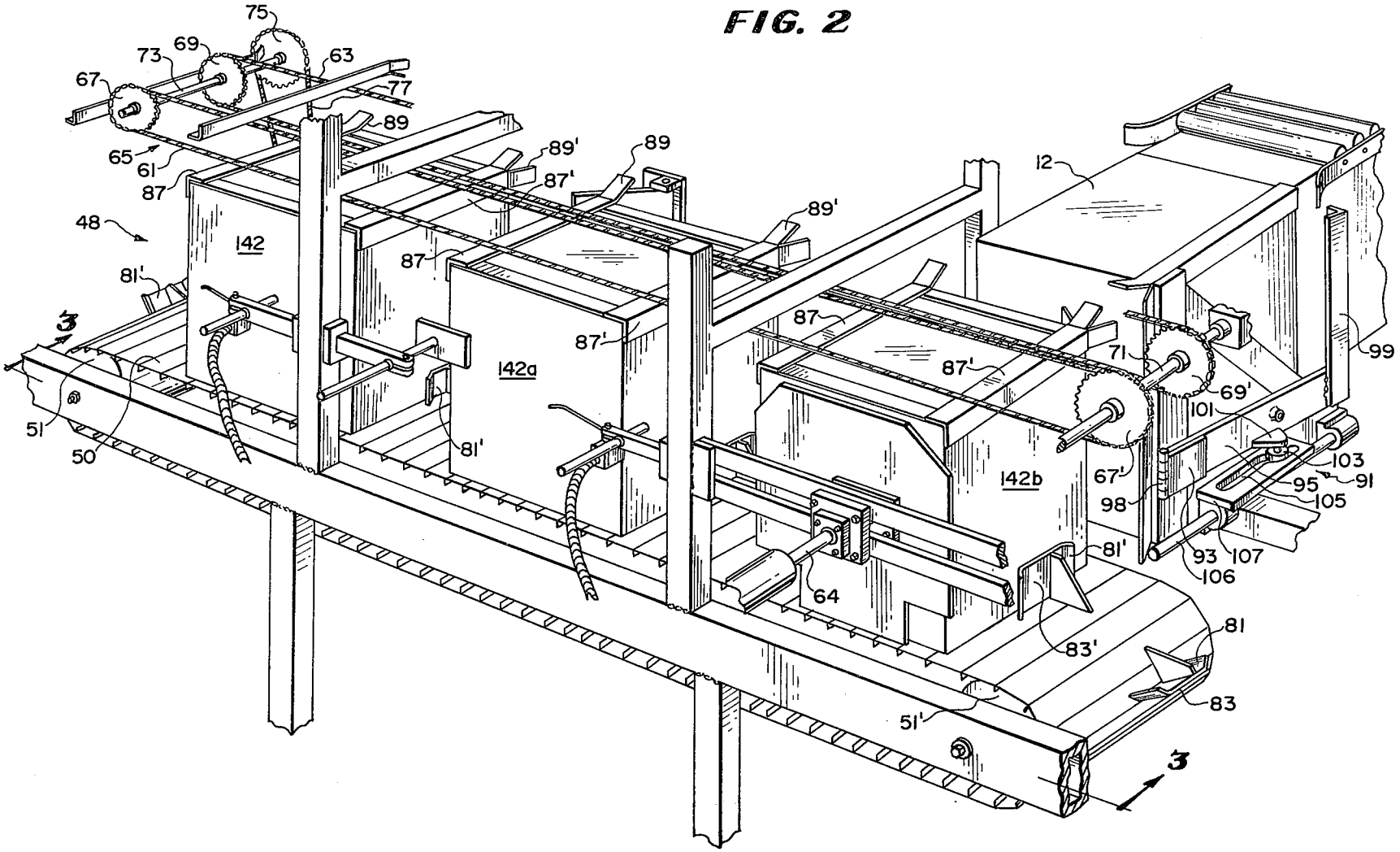
FIG. 2 is a perspective view of the conveyor mechanism and discharge station of the packaging machine illustrated in FIG. 1, but with the improvements of the present invention included thereon.
Figure 3:
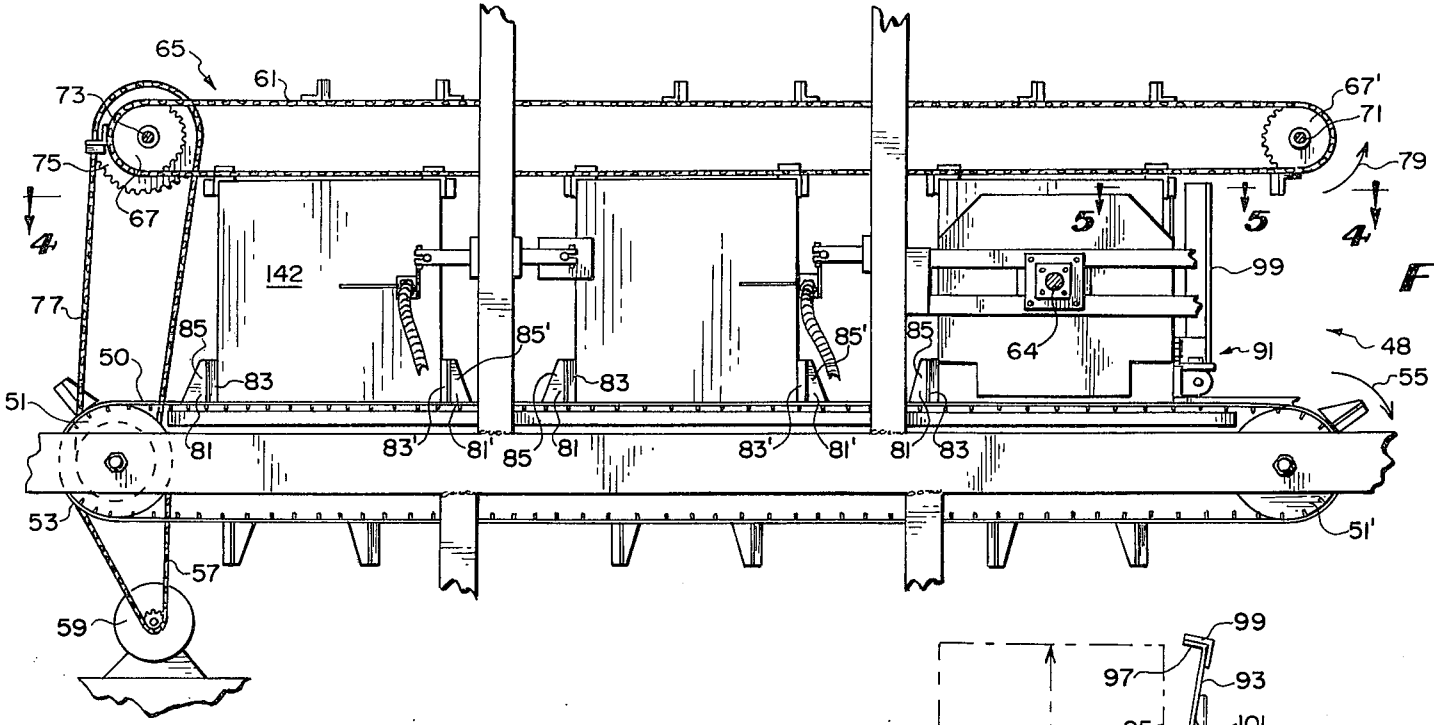
FIG. 3 is a sectional view taken along the line 3—3 of FIG. 2 in the direction indicated generally and illustrating diagrammatically drive means for the conveyors of the invention.
Figure 4:
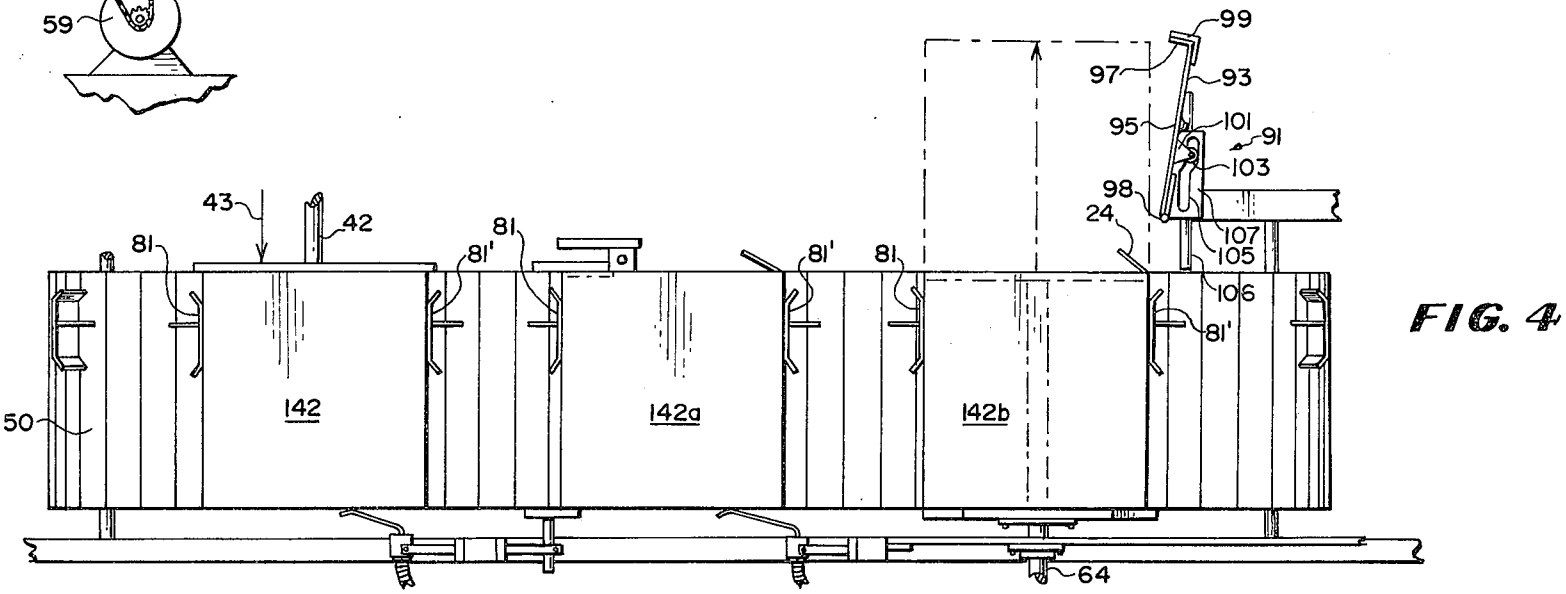
FIG. 4 is a sectional view taken along the line 4—4 of FIG. 3 in the direction indicated generally.
Figure 5:
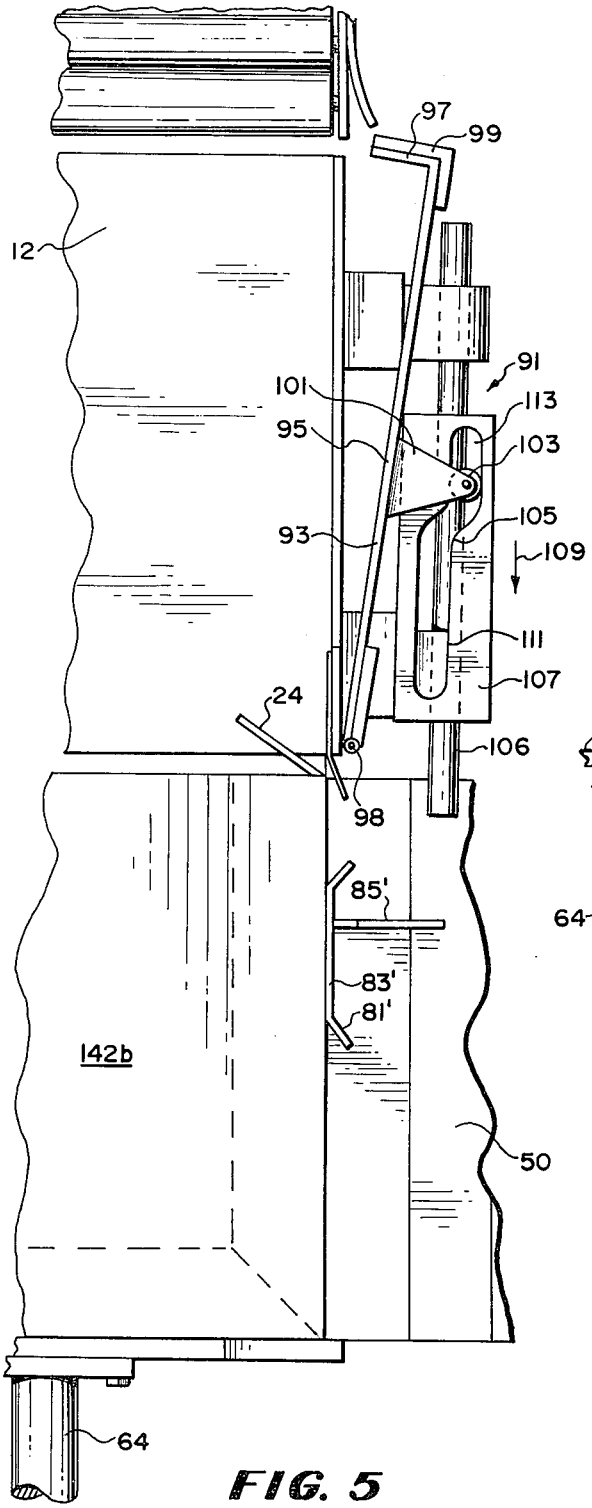
FIG. 5 is a sectional view taken along the line 5—5 of FIG. 3 in the direction indicated generally.

FIG. 1, being identical to FIG. 1 of the Related Patent, will not be further described herein; reference can be made to the specification of the Related Patent for a complete description of this Figure. In FIGS. 2 through 6 of the herein specification, like elements illustrated in FIG. 1 but not specifically described are numbered as in FIG. 1 and reference can be had to the Related Patent for a complete description thereof.

Referring to FIGS. 2 through 6, the conveyor mechanism 48 includes an endless conveyor assembly or transport section 50 in the form of a plurality of slats, a belt or other like member. The assembly 50 is trained around sprockets or rollers 51, 51′ to enable movement thereof as shown by the arrow 55 in FIG. 3. A sprocket gear 53 (FIG. 3) is provided on roller 51 and is connected by drive chain 57 to motor 59 for driving the roller and thereby the assembly 50. The drive means for the conveyor mechanism is illustrative only and can be provided adequately in other forms within the purview of the invention.

A pair of sprocket chains 61, 63 are positioned in a plane parallel to assembly 50 and spaced thereabove to form a second or upper transport section 65. The chains 61, 63 are trained respectively around sprocket gears 67, 67′ and 69, 69′; gears 67′, 69′ are mounted for rotative movement upon axle 71 and gears 67, 69 are similarly mounted on axle 73. A third sprocket gear 75 is mounted on axle 73 having gears 67, 69 and a drive chain 77 is trained about gear 53 and gear 75 such that movement of gear 53 also will move gear 75 and chains 61, 63 as shown by the arrow 79 in FIG. 3. The movement of the upper transport section 65 formed by chains 61, 63 thereby is synchronized with the movement of lower transport section 50.

Lower transport section 50 is provided with pairs of retainer brackets 81, 81′, and there are six such pairs illustrated. Each of the brackets 81, 81′ includes an upright generally planar-faced member 83, 83′ and respective rigidifying brace members 85, 85′ to support the planar-faced member. The planar faces of members 83, 83′ face each other to receive therebetween a formation 142 of folded blank 10 and lading 16 as the formation is delivered onto the receiving station 58 by the moving ram 42 (FIG. 1).

Upper transport section 65 is provided with similarly arranged pairs of retainer brackets 87, 87′ secured to chains 61, 63. Brackets 87, 87′ are formed of generally L-shaped members with flared ends 89, 89′ to guide the formation 142 into the brackets and retain the upper corners of the formation therebetween. The retainer brackets 87, 87′ respectively are in registry with brackets 81, 81′ such that formation 142 is maintained therebetween in squared-up configuration as the same is moved along the conveyor mechansim 48 to the discharge station 60. The upper and lower brackets enable positive engement and accurate movement of the formation along the conveyor mechanism as it passes through the stations thereof.

The provision of upper and lower conveyor transport section indexed to move in synchrony to the several stations described enables swifter movement of packages and more accurate placement thereof at each station. The retainer brackets of the transport sections and the package formations in line with each station and help keep the incomplete formations squared off properly in their movement to and between the stations.

Looking again at FIGS. 2 and 4 through 6, when the formation 142 moves through the intermediate station 62 (to become formation 142*a*) and into the discharge station 60 with the end flanges 24 folded over as shown by the formation 142*b*, the formation 142*b* is ready to be pushed out of the discharge station by pusher mechanism 64 against a cover blank 12. Prior thereto, adhesive is applied to the margin of the cover blank 12 as described in the Related Patent. In order to maintain the end flanges 24 in folded-over position until the same are engaged by the cover blank 12, a pair of oppositely disposed retaining members 91 is provided at the station into which the formation 142*b* is moved from the discharge station 60. Members 91 are of identical but oppositely arranged construction; only member 91 seen in the drawings therefore will be described in detail.

Figure 6:
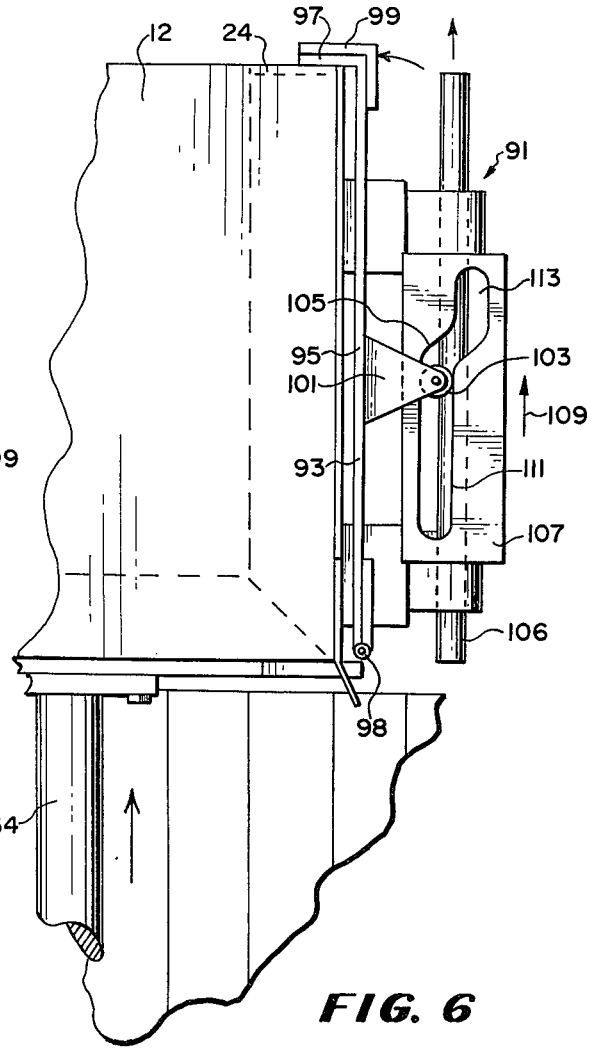
FIG. 6 is a view similar to FIG. 5 showing a second operational position of the end flange retaining bracket of the invention.

Each member 91 includes a generally L-shaped bracket 93 with a long leg 95 and a short, flange engaging leg 97, and is pivotally positioned for movement about pivot pin 98 between a first or flange engaging position shown in FIG. 6, and a second position in which the short leg 97 is moved out of the path of the formation 142*b*. A L-shaped extension member 99 is secured to short leg 97 by weldment for example, and is disposed normal to the elongate length of long leg 95. Extension member 99 is adapted to engage the formation 142*b* along substantially the entire height thereof to exert pressure along the length of flange 24.

The long leg 95 is provided with an outstanding flange 101 for retaining a cam roller 103 depended therefrom. Cam roller 103 is engaged in cam track 105 provided on camming member 107, there being an identical camming member (not shown) associated with the retaining member not illustrated. Camming member 107 is movable by operation of shaft 106 in opposite directions as shown by the arrows 109 in FIGS. 5 and 6 to operate the cam roller 103 in cam track 105. The cam track has two sections 111, 113 offset from each other such that when the camming member is moved to the position of FIG. 6, roller 103 is moved to section 111 to pivot retaining member 91 into the flange engagement position shown; when the camming member is moved to the position of FIG. 5, roller 103 is moved to section 113 to pivot retaining member 91 into a second position in which short leg 97 is moved out of the path of formation 142*b*.

In operation, formation 142*b* is moved out of discharge station 60 to a location adjacent retaining members 91. At this state, camming member 107 is in the position shown in FIG. 5. Shaft 106 thereupon is activated to move camming member 107 to the position shown in FIG. 6 in which bracket 93 engages the end flanges of formation 142*b* as described. Bracket 93 remains in this position for a short period until the end flanges are engaged by the inner facing margin of the cover blank 12. The bracket also serves to maintain the formation square at its front end prior to engagement with the cover blank. Immediately prior to engagement by the cover blank, shaft 106 again is activated to move camming member 107 to the position shown in FIG. 5; the next formation 142*b* is then moved out of the discharge station to push the previous formation with cover blank engaged thereon into the next station of the machine and the operation is repeated.

Variations can be made without departing from the spirit or scope of the invention as defined in the appended claims.

We claim:

1.. A machine for forming a sealed package containing lading from a generally rectangular body blank of paperboard material and a generally rectangular cover blank of a flexible paper or paper-like material, the body blank including a center panel, alternate, hingedly connected side panels and flanges hingedly connected along the longitudinal edges of the center and side panels and along the ends of the side panels, and the cover blank including a center panel and alternate hingedly connected side panels, said machine comprising, first means for positioning the body blank in a generally vertical plane adjcent the outlet of a lading moving station from which a quantity of lading is moved horizontally in one direction, conveying means positioned for horizontal movement in a direction laterally of said one direction, said conveying means including a receiving station adjacent said lading moving station and a discharge station spaced downstream from said receiving station, second means at said receiving station for folding the body blank into a generally U-shaped formation partially surrounding a quantity of lading with the center panel forming an end wall and the side panels forming two side walls of the formation as the quantity of lading is moved from the lading moving station, engages the body blank and moves onto said conveying means, third means at said receiving station for folding the flanges along each longitudinal edge of the body blank to positions generally perpendicular to the associated side walls and end wall during movement of the lading against the body blank and onto said conveying means, fourth means for folding the end flanges to a position generally perpendicular to the associated side walls, said conveying means including top and bottom transport sections for engaging a folded body blank therebetween, said transport sections being operatively synchronized to move in unison and jointly index a folded body blank and lading along said conveying means to said discharge station, fifth means for positioning the cover blank in a generally vertical plane adjacent said discharge station, sixth means at said discharge station for moving the folded body blank and lading laterally off of said conveying means and against the cover blank, seventh means at said discharge station for folding the cover blank into a U-shaped formation partially surrounding the lading with the margin of the cover blank positioned overlying the flanges of the folded body blank as the folded body blank formation is moved off of said conveying means, and eighth means adjacent said discharge station for retaining the flanges of the body blank in folded-over position until the same are engaged by the adjacent facing margin of the cover blank.

2. A machine as claimed in claim 1 in which said top transport section includes a pair of sprocket chains and said bottom transport section includes an endless conveyor, said sections being spaced in respective parallel planes one above the other for receipt of a body blank with lading formation therebetween.

3. A machine as claimed in claim 2 in which the conveyor is driven by a drive chain connected between the conveyor and a drive motor.

4. A machine as claimed in claim 3 in which the sprocket chains are driven by a drive chain connected between the sprocket chains and the conveyor.

5. A machine as claimed in claim 2 in which the conveyor includes pairs of oppositely facing retainer brackets to receive said formation therebetween.

6. A machine as claimed in claim 5 in which the chains include pairs of retainer brackets to retain the formation therebetween, and respective conveyor brackets and chain brackets are in registry to maintain the formation in squared-up configuration therebetween.

7. A machine as claimed in claim 5 in which the brackets each include an upright generally planar-faced member and a rigidifying brace member.

8. A machine as claimed in claim 6 in which the retainer brackets on the chains are of generally L-shaped configuration with flared ends to guide a formation therebetween.

9. A machine as claimed in claim 1 in which said eighth means include cam-actuated bracket members for moving into engagement with the end flanges and thereafter moving out of engagement with the end flanges prior to engagement of the body blank with the cover blank.

10. A machine as claimed in claim 9 in which said bracket members respectively include a pivotal generally L-shaped bracket with a short leg for movement into and out of engagement with the flanges.

11. A machine as claimed in claim 10 in which an elongate extension is provided on the short leg for engagement with the formation along substantially the entire height thereof.

12. A machine as claimed in claim 10 in which said bracket members respectively include a long leg, an outstanding flange provided on the long leg, and cam means associated with the flange.

13. A machine as claimed in claim 12 in which said cam means include a cam roller depended from the flange, a camming member for receipt of the roller in a cam track thereof, and said track has two sections one offset from the other such that when the camming member is moved to a first position the roller is moved into a first section of the track and the bracket members engage the flanges, and when the camming member is moved to a second position the roller is moved into a second section of the track and the bracket members are moved away from the flanges.

* * * * *